US009499959B2

(12) United States Patent
Zamorano Jones et al.

(10) Patent No.: US 9,499,959 B2
(45) Date of Patent: Nov. 22, 2016

(54) ROLLED AND FOLDED LIP AND MANUFACTURING METHOD THEREOF

(71) Applicant: Minetec S.A., Santiago (CL)

(72) Inventors: Claudio Zamorano Jones, Santiago (CL); Bernardo Vera Torres, Santiago (CL); Jean-Pierre Vidal Piesset, Santiago (CL)

(73) Assignee: Minetec S.A. (CL)

( * ) Notice: Subject to any disclaimer, the term of this patent is extended or adjusted under 35 U.S.C. 154(b) by 11 days.

(21) Appl. No.: 14/612,349

(22) Filed: Feb. 3, 2015

(65) Prior Publication Data

US 2016/0153177 A1 Jun. 2, 2016

(30) Foreign Application Priority Data

Dec. 2, 2014 (CL) ..... 3295-2014

(51) Int. Cl.
*E02F 9/28* (2006.01)
*E02F 3/14* (2006.01)

(52) U.S. Cl.
CPC ..... *E02F 9/2883* (2013.01); *E02F 3/141* (2013.01); *E02F 9/285* (2013.01); *E02F 9/2858* (2013.01)

(58) Field of Classification Search
CPC ..... E02F 3/36; E02F 3/40; E02F 3/8132; E02F 9/00; E02F 9/2883; E02F 9/285; E02F 9/2825; E02F 9/2808; E02F 3/141; E02F 9/2858
USPC ..... 37/444, 446, 450–453; 172/701.1–701.3, 772.5
See application file for complete search history.

(56) References Cited

U.S. PATENT DOCUMENTS

| | | | | |
|---|---|---|---|---|
| 4,570,365 A * | 2/1986 | Bierwith | E02F 9/2808 37/446 |
| 6,434,865 B2 * | 8/2002 | Renski | E02F 3/8152 172/772.5 |
| 6,990,760 B1 * | 1/2006 | Zaayman | E02F 3/36 37/446 |
| 2005/0241195 A1 | 11/2005 | Bierworth | |
| 2013/0145660 A1 | 6/2013 | Zamorano Jones | |

FOREIGN PATENT DOCUMENTS

CA 2319619 A1 2/2002

* cited by examiner

*Primary Examiner* — Robert Pezzuto
(74) *Attorney, Agent, or Firm* — Hoffman Warrick LLC

(57) ABSTRACT

A rolled lip for rope shovel machine buckets and for excavator buckets of high hardness and improved weldability is provided. The rolled lip is folded and used in buckets with capacities above 25 $m^3$. The lip is made of rolled steel plates of up to 3,000 mm wide and 12,000 mm long and up to 250 mm thick, wherein the steel has flow characteristics between 600 and 900 MPa. The noses and holes used to build the lip are drilled and the shape of the noses is provided by templates or gauges. A method for manufacturing such a rolled lip is also provided.

9 Claims, 9 Drawing Sheets

ROLLED AND FOLDED LIP AND MANUFACTURING METHOD THEREOF

CROSS-REFERENCE TO RELATED APPLICATIONS

This application claims the benefit of co-pending Chilean Patent Application No. CL 3295-2014, filed 2 Dec. 2014, which is hereby incorporated herein.

TECHNICAL FIELD

The invention is related to the field of components for earthmoving equipment, specifically a large rolled and folded lip for excavator bucket, and to a method for manufacturing it.

DESCRIPTION OF THE PRIOR ART

Today's bucket lips for rope shovel machines and front excavators or special backhoes, for capacities above 25 $m^3$, are manufactured cast, resulting in that said lips' material typically has a hardness of about 240 HB and low weldability that makes repairs difficult, factors affecting the durability and ease of repair tasks.

In the state of the art, there are patent documents related to lips for backhoes; we can mention, for example, document CA2319619A1, showing a lip whose ends are curved, the lip has two rolled steel plates and an additional plate welded to said lip, there is mention of a method to obtain a folded curved lip like the one proposed by the invention.

Another application related to lips for backhoes is US2005241195, which also discloses a lip with curved edges, there is also no mention of a method to obtain a rolled lip by folding.

Finally, we can mention the Chilean application 3127-2011, which discloses a rolled lip; in this case, the lip is straight so the folding process is not used.

SUMMARY OF THE INVENTION

The invention consists of a rolled lip that has a higher weldability and is more resistant because it is made of rolled stainless steel and is used for excavator buckets, the lip obtained is of high hardness and improved weldability, it is folded and used in buckets with capacities above 25 m3, said lip is made of rolled steel plates of up to 3,000 mm wide and 12,000 mm long and up to 250 mm thick and wherein said steel has flow characteristics between 600 and 900 MPa, the lip's holes and noses are drilled using roughing, machining, drilling, grinding and oxy-cutting tools. The width, height and shape of the noses are provided by templates or gauges.

DETAILED DESCRIPTION OF THE INVENTION

Figure 1:
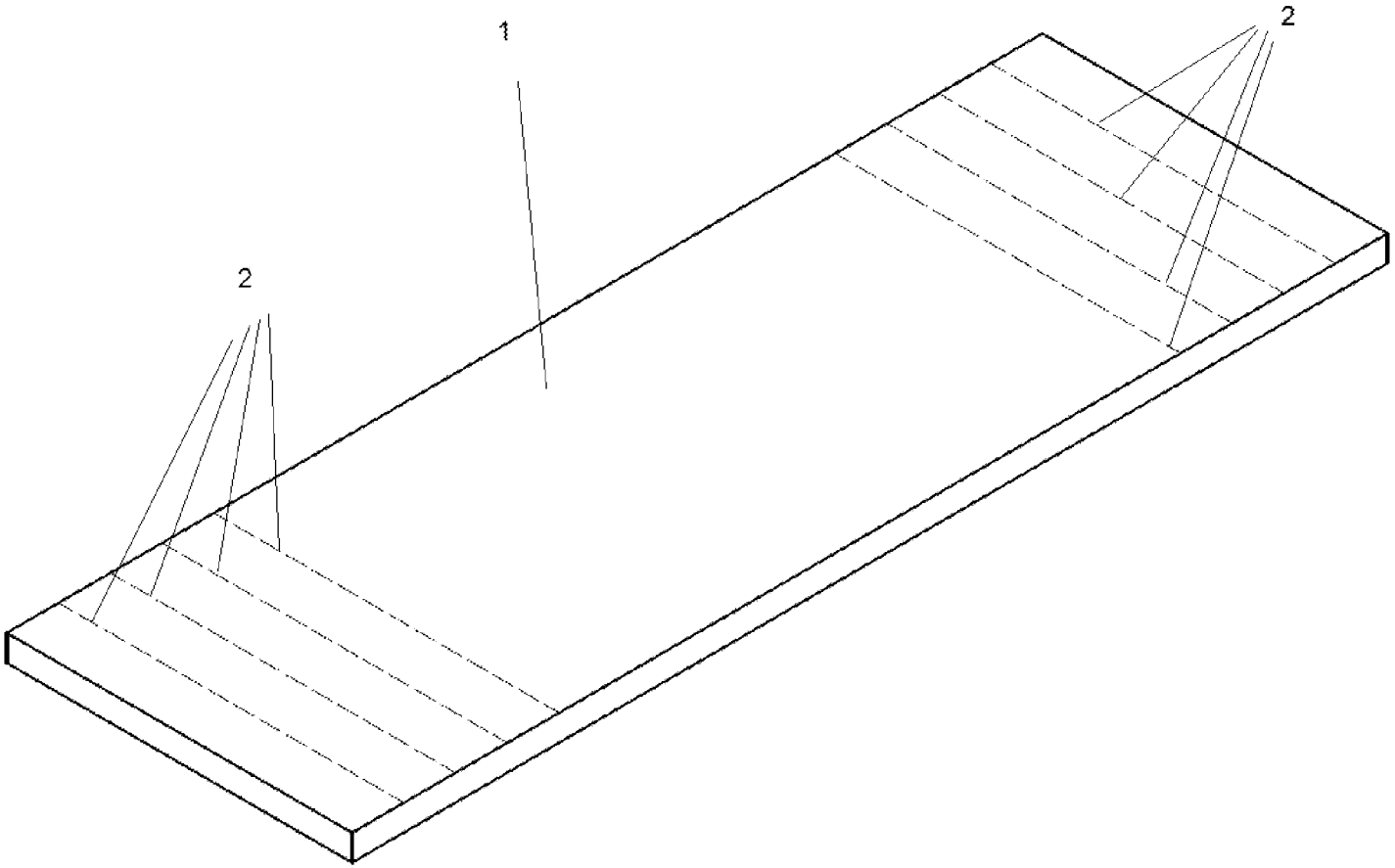
FIG. 1 shows a rolled steel plate with folding lines which has not been folded.
Figure 2A:
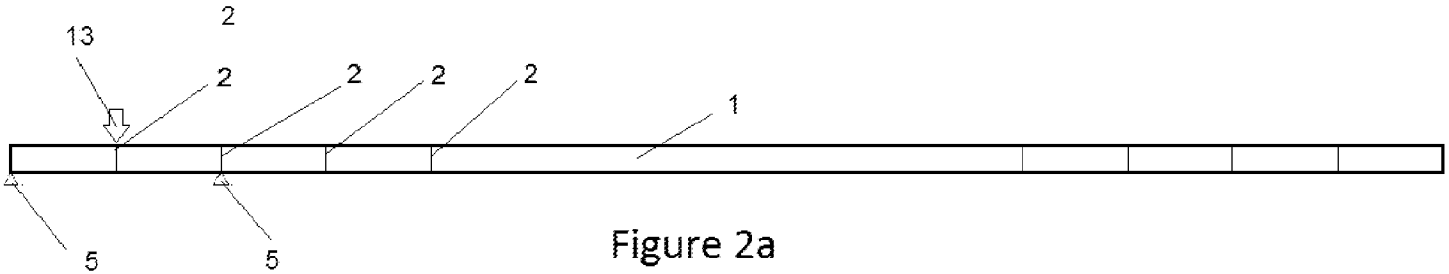
FIG. 2*a* shows the folding to curve the plate which is unfolded.
Figure 2B:
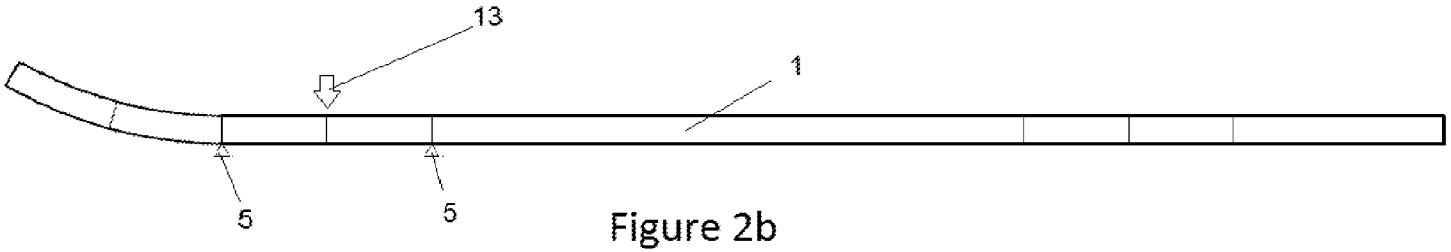
FIG. 2*b* shows the folding to curve the plate after a first folding.
Figure 2C:
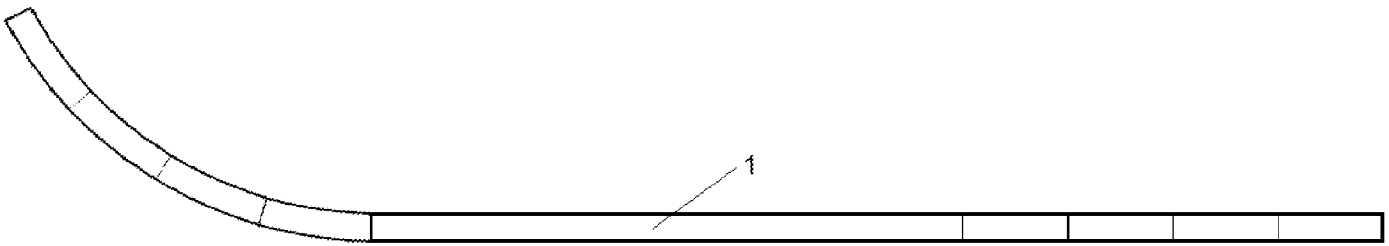
FIG. 2*c* shows the folding to curve the plate after a second folding.

The proposed invention discloses a method to obtain a large rolled and folded lip, that is, a lip for buckets, rope shovels and front excavators or backhoes over 25 m3. The lip in question is obtained from a rolled steel plate (1) of a predetermined thickness with the approximate width and height dimensions of the lip to be obtained. The proposed invention may use rolled steel plates (1) up to 3,000 mm wide and 12,000 mm long with thicknesses up to 250 mm and a flow stress of 600-900 MPa and weighing between 7-14 tons. To obtain a finished lip, some steps must be followed: first, folding lines (2) are marked on both sides of the plate (1) as shown in FIG. 1, these lines (2) are used to apply a folding pressure on them by a punch (13) and a die (4) located on a press. To best illustrate, FIGS. 2*a*, 2*b* and 2*c* show the steps of folding a rolled steel plate (1) at one end. FIG. 2*a* shows the first folding where the pressure of the punch (13) is applied on one of the lines (2) on the plate in which no folding has yet been made, for this, the plate is supported below by the two edges (5) of the die (4) which are separated by a distance A which depends on the design and dimensions of the die (4) for each lip to be folded, by applying a pressure of the punch (13) until a certain predetermined depth, the plate is curved in the section where it was between the two edges (5) of the die (4), as shown in FIG. 2*b*, then the plate (1) moves to the left of the figure, as shown in the same FIG. 2*b*, until placing the punch on a new folding line and the edges (5) of the die (4) on another location, having placed the punch on this second folding line, pressure is applied resulting in a new folding, as shown in FIG. 2*c*. For the purposes of illustration, in this case, only two foldings of this process are shown, a process which is carried out at all steps as necessary to achieve the desired curvature.

Figure 3:
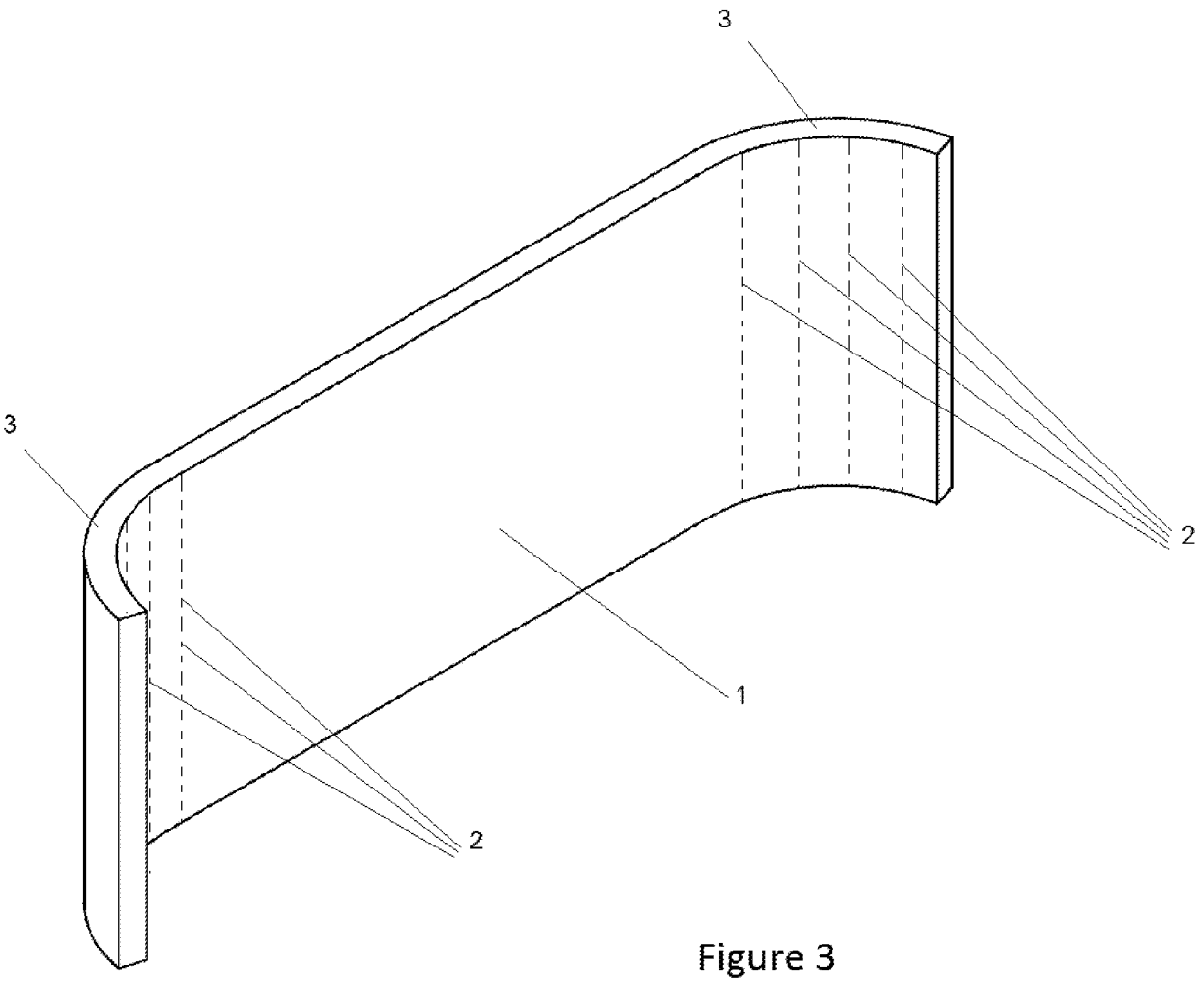
FIG. 3 shows a plate that is folded and ready for the drilling step.
Figure 4:
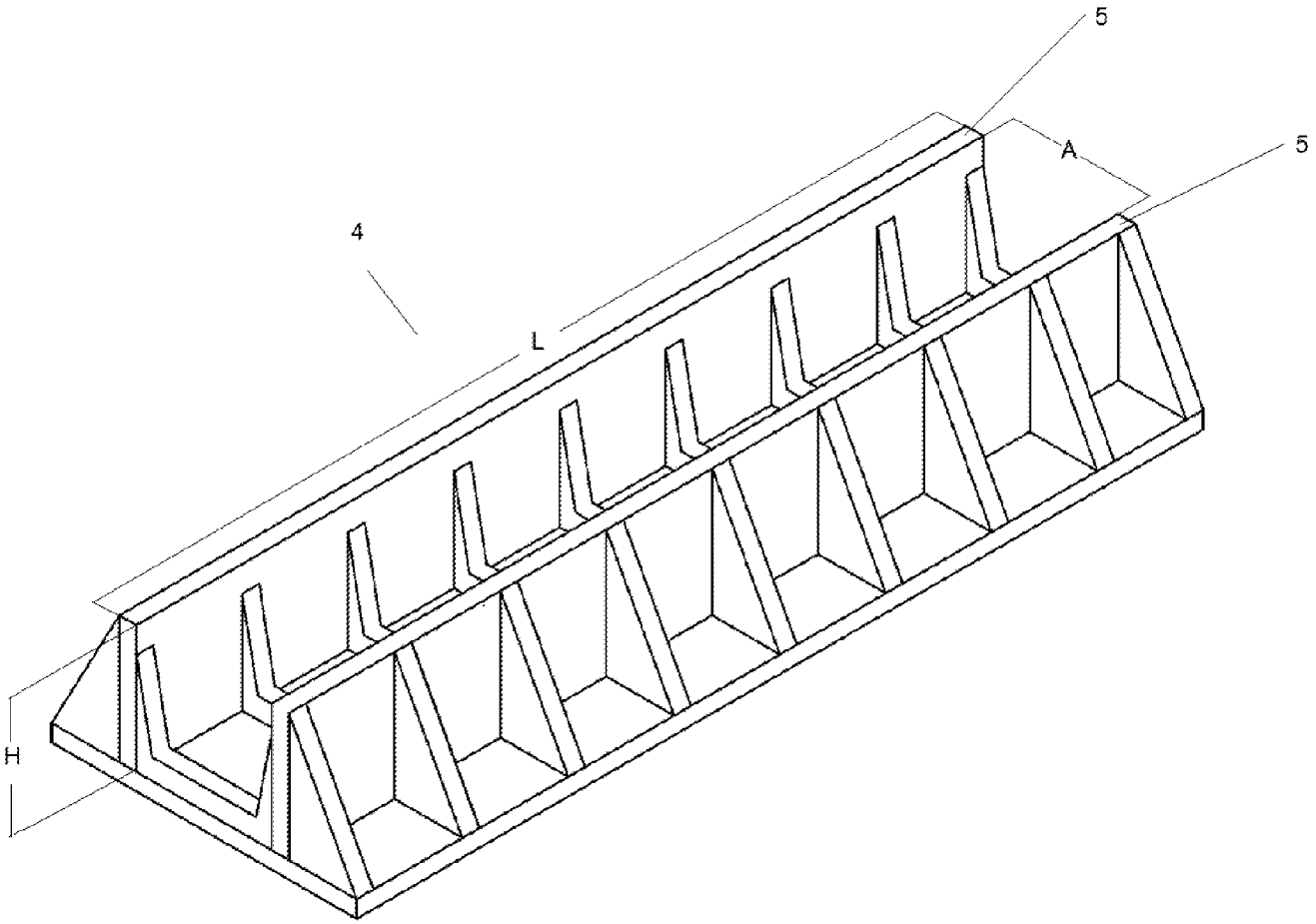
FIG. 4 shows a die.

Depending on the dimensions and material of the plate (1) the number of lines (2) may vary, and consequently the number of foldings necessary to achieve the desired curvature, which can be at the ends, as shown in FIG. 2*c*, or on the entire plate, having different folding radii along the plate. It is also necessary to consider that, according to these dimensions and material of the lip, other factors may vary too, such as the depth of folding with the punch and especially the dimensions of the die, in its length (L), width (W) and height (H), depending on the case, it is estimated that the weight of the die is 2-3 times the weight of the lip. Once one side of the plate (1) has been finished, where the curvature has been achieved by necessary folding, the plate (1) is rotated 180° and the folding process is started using the folding lines of the other end of the plate (1) to finally achieve a curved plate at its ends (3), as shown in FIG. 3.

Once the process of folding the plate (1) is finished, this is placed as shown in the same FIG. 3, so as to be able to drill, on one if its edges, the noses (6) where the lip's adapters and/or teeth, as may be the case, will be subsequently located, also in this step, holes (8) may be made on the plate, in case of being necessary for final use. The process of drilling and perforating the plate is carried out using tools such as roughing, machining, drilling, grinding and oxy-cutting tools.

In a first step, oxy-cutting is applied to obtain a recessed edge (7) projecting toward the edges of the plate (1) and between the noses (6), a profile is thus obtained where an approximate shape of the noses (6) and the recessed edge (7) is achieved, finally, a final shape of the lip's flow edge is obtained by the drilling process.

Figure 5B:
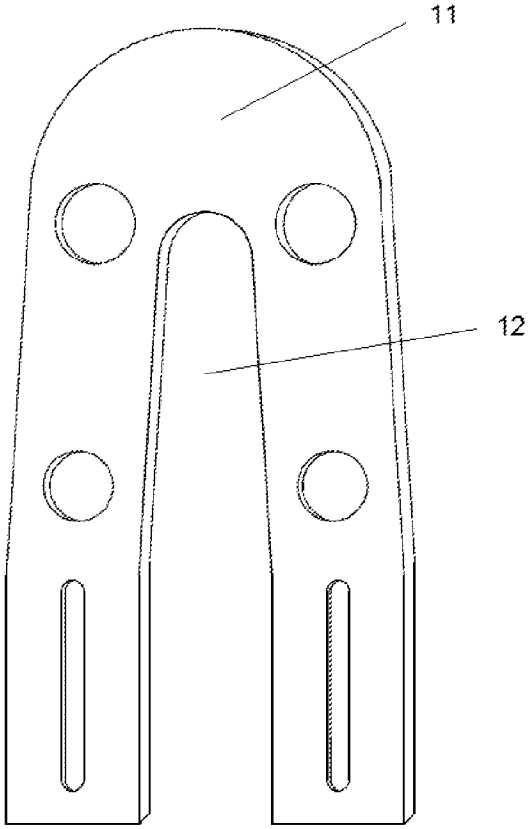
FIG. 5*b* shows a second template to give the thickness and shape of the nose.
Figure 5A:
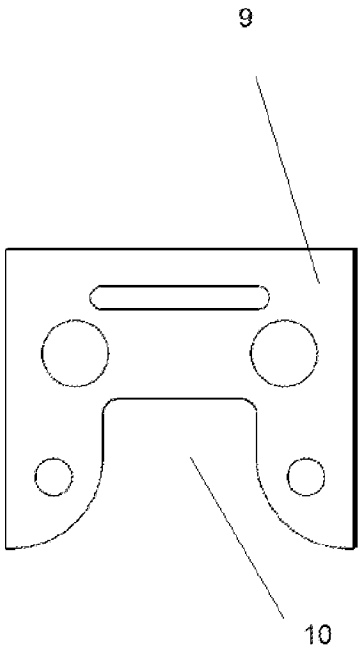
FIG. 5*a* shows a first template to provide the width and shape of the nose.

The drilling process is basically a process of machining and/or processing with manual tools where, besides the roughing, machining, drilling, grinding and oxy-cutting tools, templates (9, 11) are used, as shown in FIGS. 5*a* and 5*b*, which serve as gauges for shaping the nose (6) with respect to its width, height and thickness, and making the holes (8).

Figure 6B:
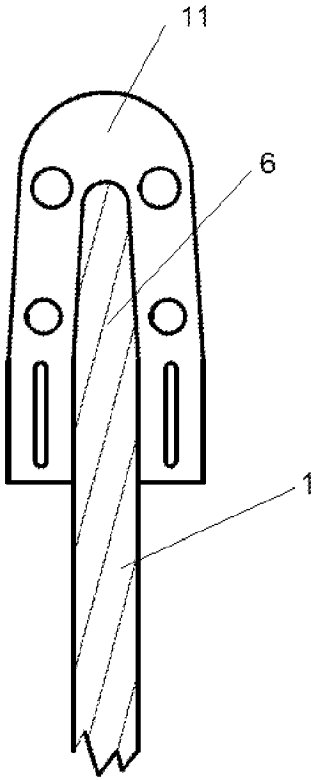
FIG. 6*b* shows how the second template is used to provide the thickness and shape of the nose.
Figure 6A:
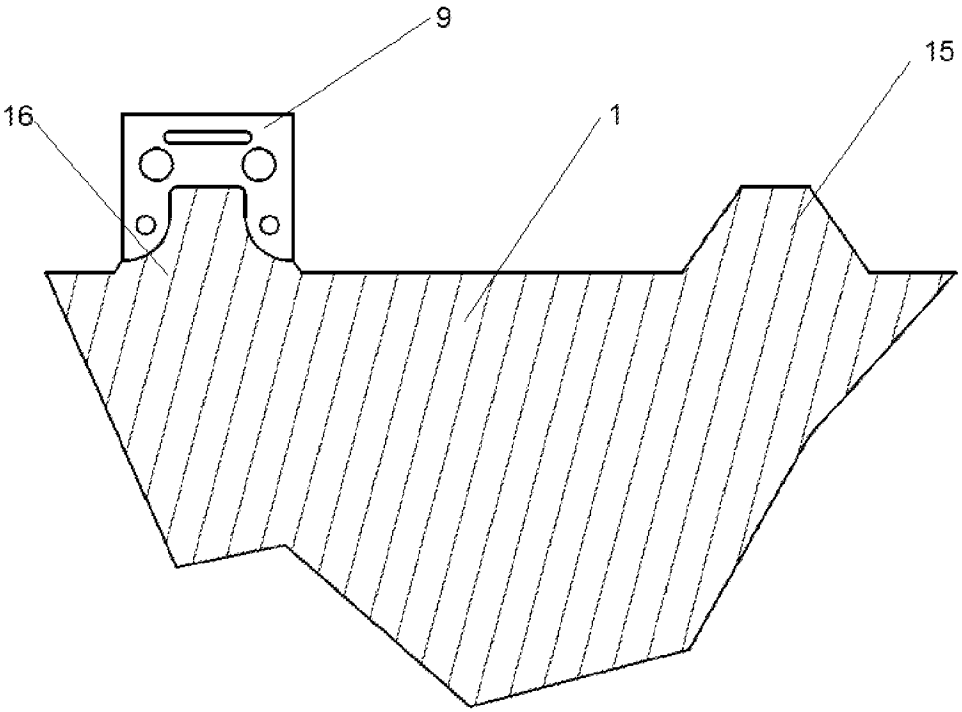
FIG. 6*a* shows how the first template is used to provide the width and shape of the nose.
Figure 7:
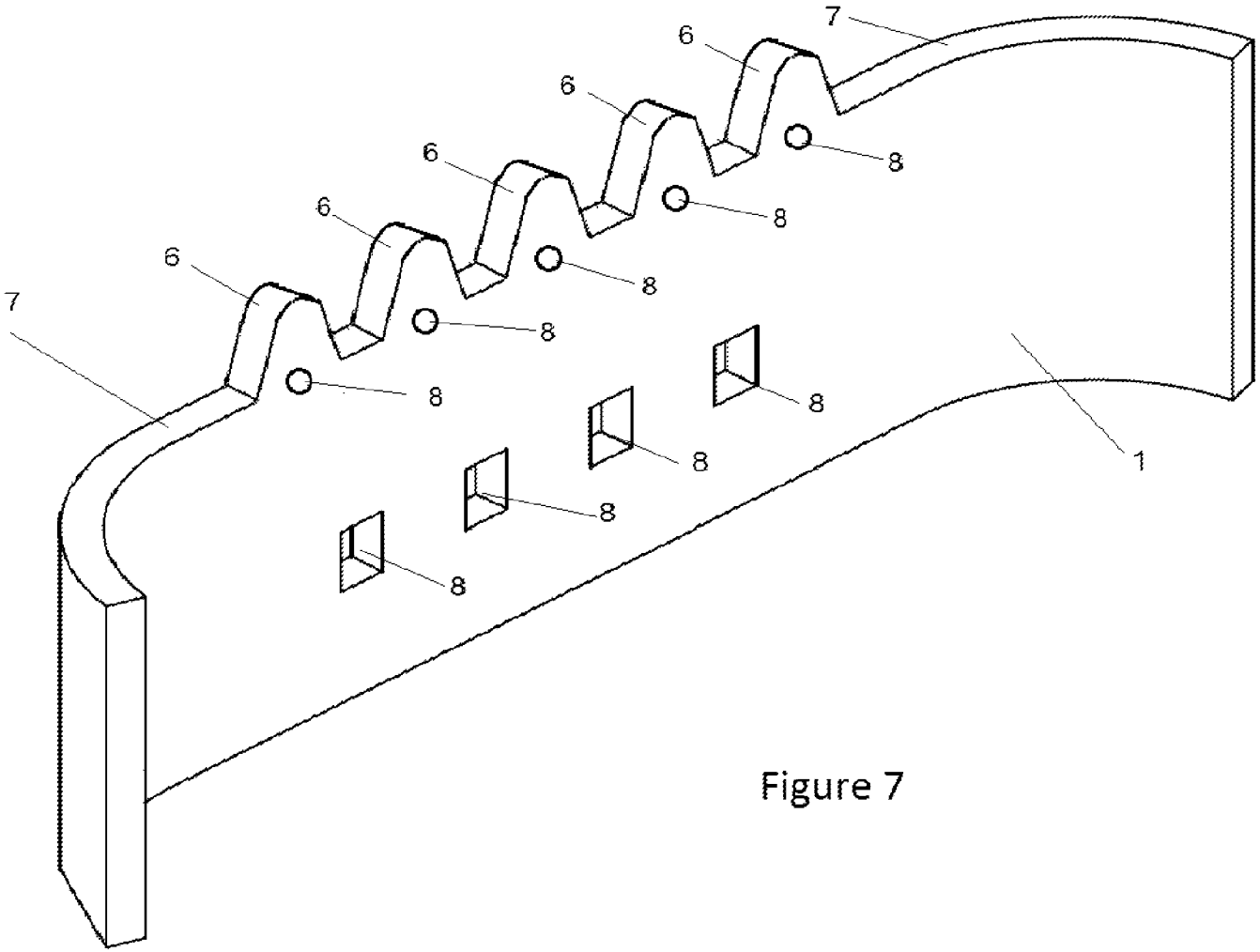
FIG. 7 shows a schematic view of the finally shaped plate, obtaining the folded lip with its noses and other holes.

As shown in FIG. 5*a*, there is a first template or gauge (9) for drilling, which is used to provide the width, height and shape of the nose, placing the first template or gauge (9) in said nose, as shown in FIG. 6*a*, FIG. 6*a* also shows a nose that has not been drilled and machined (15), and a nose that is in the process of being drilled and machined (16), in this case, work is made using manual tools, placing said that template or gauge (9) on the nose until the cavity (10) of the template or gauge (9) fits the shape of the nose (6). Once a nose (6) is finished, the process continues to work on the next nose (6) until it fits again the shape of the cavity of the template or gauge (9); the process is repeated until finishing all noses (6) required by the design.

As shown in FIG. 5*b*, there is a second template or gauge (11) used to provide the shape and thickness of the nose (6), in this case, work is also made using manual tools, placing the second template or gauge (11) on the tooth until the cavity (12) of the template or gauge (11) fits the shape of the nose (6). Once a nose is finished, the process continues to work on the next nose (6) until it fits the shape of the cavity of the template or gauge (11); the process is repeated until finishing all noses (6) required by the design. Noses may be different from each other, in which case there is more than one set of templates.

Then, all the necessary holes (8) are made on the plate, providing adequate finish, also using the roughing, machining, drilling, welding or grinding tools.

Finally, a wear-resistant hardened steel layer is installed, which can extend the life of the component. This steel layer on standard cast lips is part of the base material, thus, with the same or a lower weight and with the same thickness of the steel, the lip obtains a surface more resistant to abrasion than cast.

Figure 8:
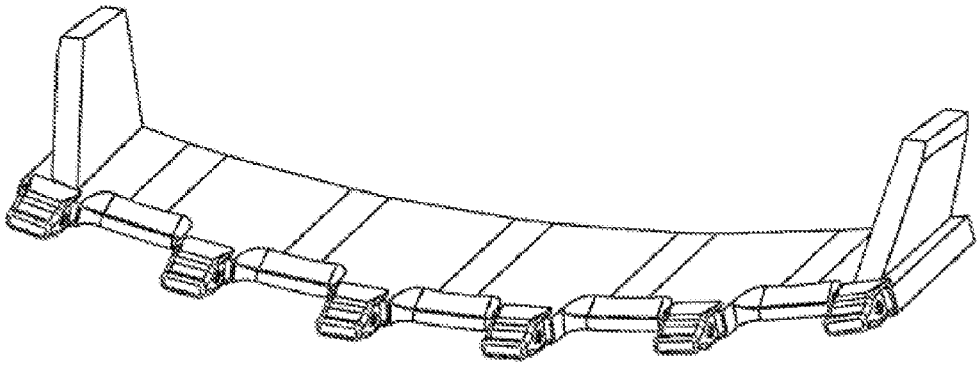
FIG. 8 shows a type of lip that may be obtained with this invention.

FIG. 8 shows a type of lip in which curving of the plate (1) is possible, in this case, drilling of the noses (6) is also carried out, as described above, and once the process of folding and drilling is finished, the side edges (14) are welded to the plate (1).

Figure 9:
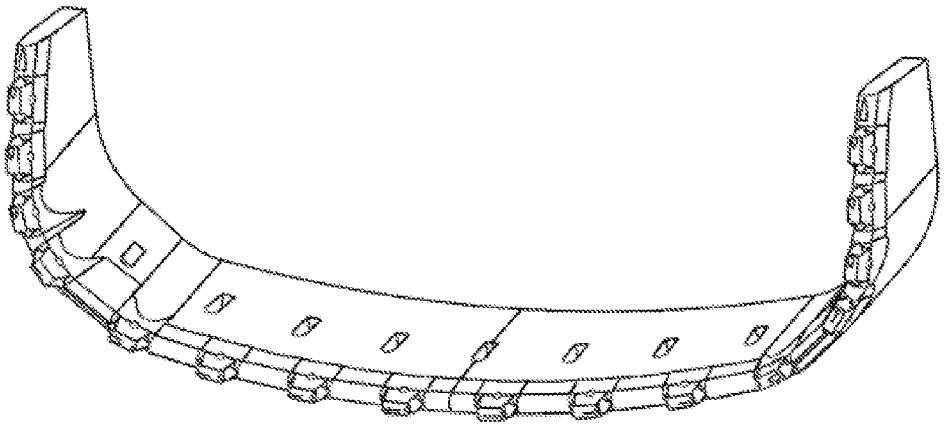
FIG. 9 shows another type of lip that may be obtained with this invention.
Figure 10:
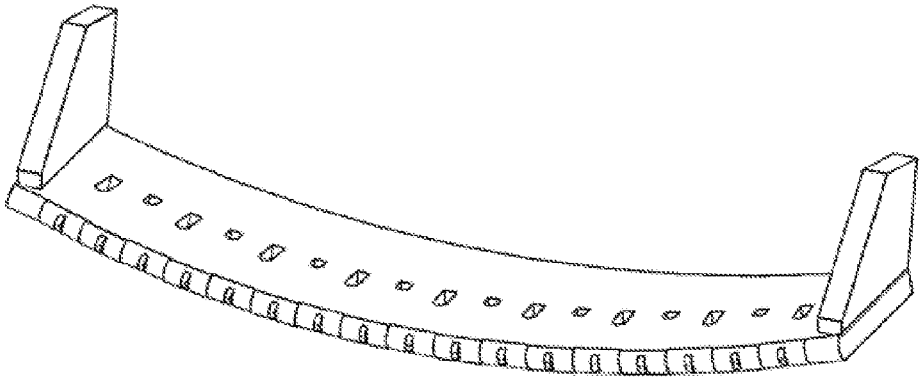
FIG. 10 shows another type of lip that may be obtained with this invention.

FIGS. 9 and 10 show other types of lips that may be made by means of the method described.

Figure 11:
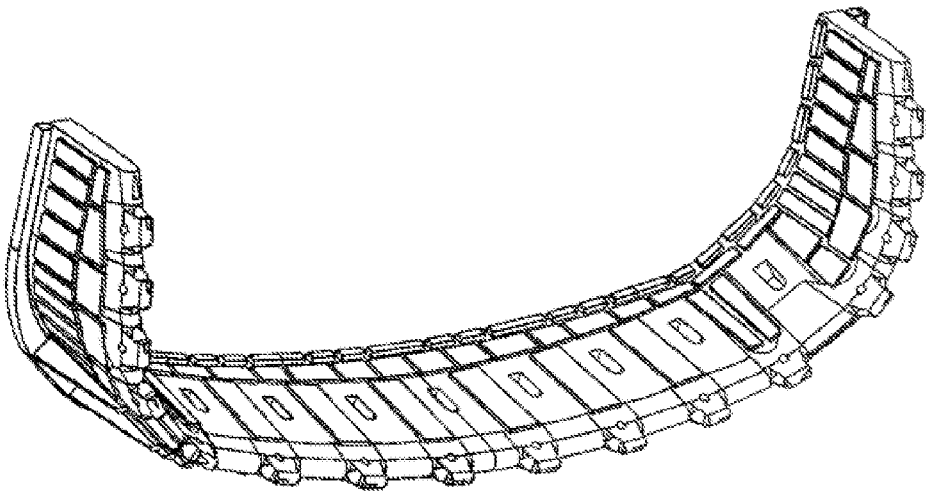
FIG. 11 shows an example of wear-resistant steel plates installed on the lip.

FIG. 11 shows a lip with the hardened steel layer installed.

The invention claimed is:

1. A rolled lip with high hardness and improved weldability wherein the rolled lip:
- is folded;
- is for buckets with capacities above 25 $m^3$;
- is manufactured with a single rolled steel plate up to 3,000 mm wide and 12,000 mm long and up to 250 mm thick and having
- a flow stress between 600 and 900 MPa;
- includes noses and holes that are drilled; and
- the shape of the noses is obtained with templates or gauges.

2. The rolled lip according to claim 1, wherein the rolled lip is folded using a press with a punch and a die in steps.

3. The rolled lip according to claim 2, wherein the press has a capacity of at least 1,600 tons.

4. The rolled lip according to claim 2, wherein a weight of the die is 2-3 times a weight of the lip.

5. The rolled lip according to claim 1, wherein the noses and holes are made using roughing, machining, drilling, grinding and oxy-cutting tools.

6. The rolled lip according to claim 1, wherein a width, a height and a shape of the noses are provided by at least one first template or gauge.

7. The rolled lip according to claim 1, wherein a thickness and a shape of the noses are provided by at least one second template or gauge.

8. A method for manufacturing a rolled lip with a high hardness and improved weldability comprising the steps of:
- a) providing a rolled steel plate;
- b) providing a press with a punch and a die;
- c) marking on two opposite sides or along the rolled steel plate locations for folding;
- d) placing one of the marks facing the punch of a press and between sides of the die;
- e) applying pressure with the punch until a predetermined curvature is obtained;
- f) raising the punch;
- g) moving the plate to position the punch on a second mark;
- h) applying pressure with the punch until a predetermined curvature is obtained;
- i) moving and applying pressure with the punch of the press until folding on all remaining marks is estimated to obtain a desired curvature of one side of the plate;
- j) raising the punch and rotating the rolled steel plate by 180° with respect to a length of the rolled steel plate so as to start folding on an opposite side of the plate;
- k) repeating steps from point e) to i);
- l) placing the folded rolled steel plate for drilling;
- m) drilling an edge recessed between noses and projected onto curved edges
- n) drilling the noses with at least one of roughing, drilling, grinding, or oxy-cutting tools and templates or gauges to obtain a height, a length, and a width of each nose;
- o) making at least one hole in the plate;
- p) machining the holes with at least one of roughing, machining, drilling, grinding, or oxy-cutting tools; and
- q) installing a hardened steel layer on a surface of the rolled lip.

9. A rolled lip manufactured according to the method of claim 8.

* * * * *